US005954590A

United States Patent [19]

Nixey

[11] Patent Number: 5,954,590

[45] Date of Patent: Sep. 21, 1999

[54] GOLF PUTTING AID OR GAME

[75] Inventor: Wayne Richard Nixey, Alexander Headland, Australia

[73] Assignee: Jill Frances Nixey, Alexanda Headland, Australia

[21] Appl. No.: 08/809,838

[22] PCT Filed: Jul. 28, 1995

[86] PCT No.: PCT/AU95/00464

§ 371 Date: Mar. 21, 1997

§ 102(e) Date: Mar. 21, 1997

[87] PCT Pub. No.: WO96/09095

PCT Pub. Date: Mar. 28, 1996

[30] Foreign Application Priority Data

Sep. 22, 1994 [AU] Australia ..... PM 8342

[51] Int. Cl.[6] ..... A63B 69/36

[52] U.S. Cl. ..... 473/185; 473/171

[58] Field of Search ..... 473/159, 185, 473/158, 174, 180, 157

[56] References Cited

U.S. PATENT DOCUMENTS

| | | | |
|---|---|---|---|
| 1,693,474 | 11/1928 | Burt | 473/185 |
| 1,773,813 | 8/1930 | Gourlay et al. | 473/185 |
| 2,626,152 | 1/1953 | Miller | 473/185 |
| 3,727,918 | 4/1973 | Zawacki | 473/159 |
| 3,844,565 | 10/1974 | Gigliotti | 473/159 |
| 3,877,704 | 4/1975 | Bayley . | |
| 3,909,006 | 9/1975 | Arbaugh . | |
| 4,368,888 | 1/1983 | Ren . | |
| 4,726,591 | 2/1988 | Johnson | 473/185 |
| 5,087,046 | 2/1992 | Mauch . | |
| 5,310,187 | 5/1994 | Yamaguchi et al. . | |

FOREIGN PATENT DOCUMENTS

| | | |
|---|---|---|
| 1491886 | 10/1974 | United Kingdom . |
| 2219215 | 12/1989 | United Kingdom . |
| 2232604 | 12/1990 | United Kingdom . |
| 89/02298 | 3/1989 | WIPO . |

*Primary Examiner*—Mark S. Graham
*Attorney, Agent, or Firm*—Larson & Taylor

[57] ABSTRACT

A golf putting aid for use on a playing surface including a plurality of polygon-shaped faces forming a hollow polyhedron with at least two of the polygon-shaped faces each having a plurality of openings therethrough for receipt therethrough of a putted golf ball. Each of the at least two polygon-shaped faces may be placed flat against the playing surface such that an opening in an adjacent one of the polygon-shaped faces is exposed for receipt therethrough of a putted golf ball.

11 Claims, 9 Drawing Sheets

FRONT NINE

| HOLE | PAR | INDEX | POINTS |
|---|---|---|---|
| 1 | 3 | 17 | 2 |
| 2 | 4 | 12 | 7 |
| 3 | 4 | 7 | 12 |
| 4 | 4 | 3 | 16 |
| 5 | 5 | 9 | 10 |
| 6 | 5 | 13 | 6 |
| 7 | 4 | 10 | 9 |
| 8 | 3 | 6 | 13 |
| 9 | 4 | 15 | 4 |

Fig.8.

BACK NINE

| HOLE | PAR | INDEX | POINTS |
|---|---|---|---|
| 10 | 3 | 5 | 14 |
| 11 | 4 | 11 | 8 |
| 12 | 4 | 14 | 5 |
| 13 | 3 | 18 | 1 |
| 14 | 4 | 1 | 18 |
| 15 | 5 | 8 | 11 |
| 16 | 4 | 16 | 3 |
| 17 | 5 | 4 | 15 |
| 18 | 4 | 2 | 17 |

Fig. 9.

GOLF PUTTING AID OR GAME

BACKGROUND OF THE INVENTION

1. Field of the Invention

This invention relates to a golf putting aid or game.

2. Prior Art

Even professional golfers find that accurate putting is an important part of golf.

Whether playing against one's self or in a competition, a golfer cannot achieve a low score, unless he/she can putt the ball into the holes with a minimum number of strokes.

There have been many proposals for aids to assist golfers in practicing their putting. The simplest is a simulated hole which may be placed on a surface and the golfer putts the ball towards, and hopefully into, the simulated hole. More complicated putting aids may include means which return the golf ball to the golfer when the ball has been successfully putted into the simulated hole.

Examples of the prior art include:

(a) U.S. Pat. No. 3,909,006 (ARBAUGH): This patent is directed to a golf putting game where a plurality of blocks having ball-receiving holes are positioned in spaced-apart relationship on a plane surface. The blocks have ball-receiving holes therein and sloping surfaces which slope upwardly towards the ball-receiving holes. At least some of the blocks have the sloping surfaces thereon extending substantially less than 360° there-around so that the ball is rollable into the holes in these blocks only from the direction which faces the sloping surfaces. The blocks have a plurality of different shapes in order to vary the skill required for directing the ball into the hole in the different blocks.

(b) GB 1491886 (PLAYCO LIMITED): This patent is directed to a putting game apparatus where a portable strip-shaped target member has an inclined rolling surface sloping upwardly from a leading edge of the target towards the back thereof and at least two series of holes in the surface extending along the target member. The first series of holes are placed nearer the leading edge than the second series and are generally of greater diameter than the holes in the second series. The sections may be numbered in a manner analogous to the numbering on a dart board with high and low numbers alternately.

(c) U.S. Pat. No. 3,877,704 (BAYLEY)

This patent is directed to a golf game where different forms of targets spaced from the area, the targets generally being in the form of concentric circles defined by spacers where ramps allow the golf ball to roll into the various target zones.

(d) U.S. Pat. No. 5,310,187 (YAMAGUCHI et al): This golf putting and chipping practice device provides a self-supporting golf target which can rest on a plane surface and is designed to provide a target hole to the golfer with no impediment to a ball entering the hole through a 360° angle. The device has three side walls meeting at one arcuately shaped end, each arcuately shaped ends forming a respective one-third of the target hole.

(et) International Publication No. WO 89/02298 (PERRY et al): This document discloses a game which seeks to replicate a golf course in miniature. Target greens are positioned in a pre-determined pattern and the game is designed to allow for different degrees of difficulty.

SUMMARY OF THE PRESENT INVENTION

It is an object of the present invention to provide a putting aid which enables a golfer to improve his/her putting expertise.

It is a preferred object to provide an aid where the simulated hole or target is smaller than an actual hole to assist the golfer in achieving putting accuracy.

It is a still further preferred object to provide a putting aid which may be incorporated in a game where one or more golfers may compete over, eg. 9 or 18 holes for "points" or "strokes" and these may be applied against their handicaps.

Other preferred objects of the present invention will become apparent from the following description.

In one aspect, the present invention resides in a golf putting aid having:

a body with at least one face, the or each face having at least one hole or inlet forming a target hole into which a golf ball may be putted, the target hole(s) being of (optionally) different sizes and/or configurations to represent target holes of different degrees of difficulty.

While the aid may have a body with a single face with a plurality of holes, it is preferable that the body be a collapsible hollow polygon, eg. a cube, where two or more faces are each provided with a plurality of the target holes.

Target holes may be of different widths, heights and/or shapes. For example, a first target hole with a relatively narrow width but relatively greater height may have an effective greater target size than a relatively wider but relatively shallower height second target hole as the ball will only enter the second target hole when substantially aligned with the centre line of the second target hole.

In a second aspect, the present invention resides in a golf putting game including:

a golf putting aid as hereinbefore described;

an indexing means (optionally laid on a surface) indicating one or more locations from which the golf balls are to be putted towards the aid; and a set of Rules.

Preferably, the indexing means is an elongate strip of material which is preferably releasably engageable with the surface. A suitable material is the hook portion strip of "Velcro" (Registered Trade Mark) material which releasably engages with carpet. Alternatively, the strip may be of plain material and may have hooks, pins or the like to engage the carpet or supporting surfaces. Numbers, representing different target holes, may be marked on the upper face of the strip to indicate the different positions from which the golfer putts his/her balls.

The Rules may indicate a par value for each target hole and/or an index of difficulty for each target hole and/or points allocated to each target hole.

BRIEF DESCRIPTION OF THE DRAWINGS

To enable the invention to be fully understood, a preferred embodiment will now be described with reference to the accompanying drawings, in which:

FIGS. 8 and 9 show examples of the Index Sheets showing the "par", "index", "points" for each hole.

DETAILED DESCRIPTION OF THE DRAWINGS

The putting aid 10 has a body formed (eg., from plastic) as a collapsible hollow cube, where one face 11 may be open to assist retrieval of the golf balls from the interior of the aid, and the opposed face 12 may be solid. Pins on one or more of the faces 12–16 are releasably engageable in complementary holes in the adjacent faces.

Figure 1:
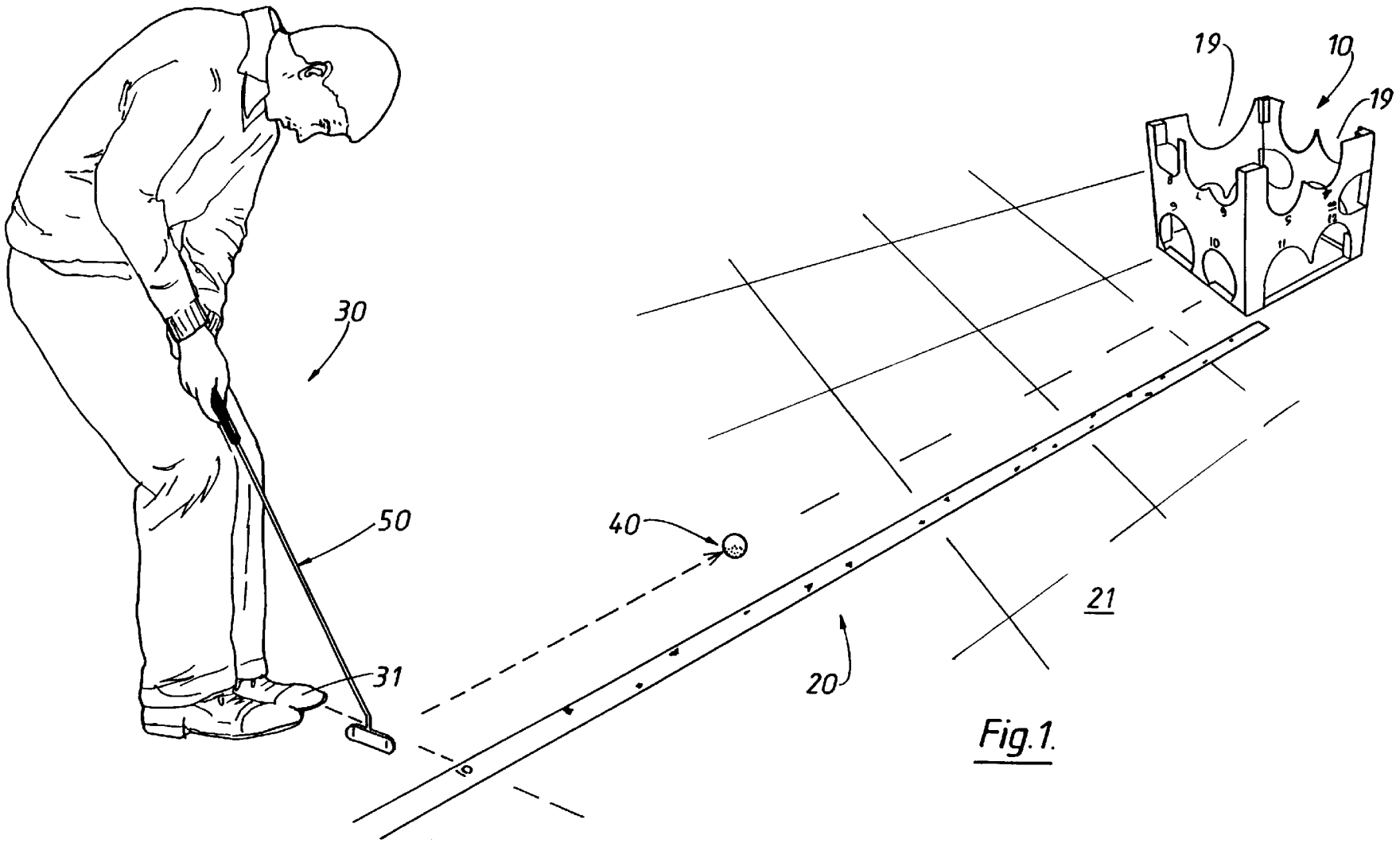
FIGS. 1 and 2 are perspective views of the golf putting game in use.
Figure 2:
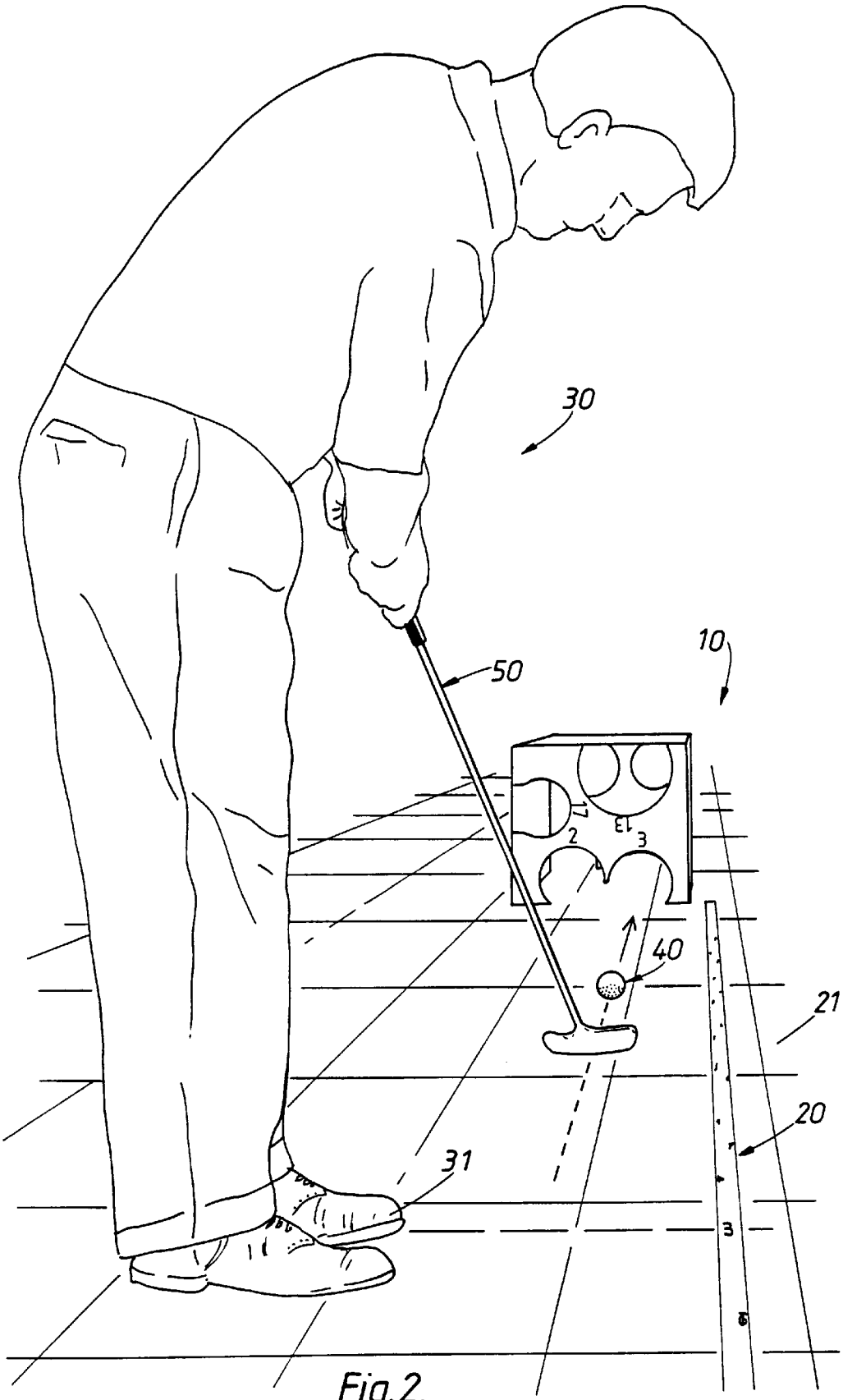
Figure 3:
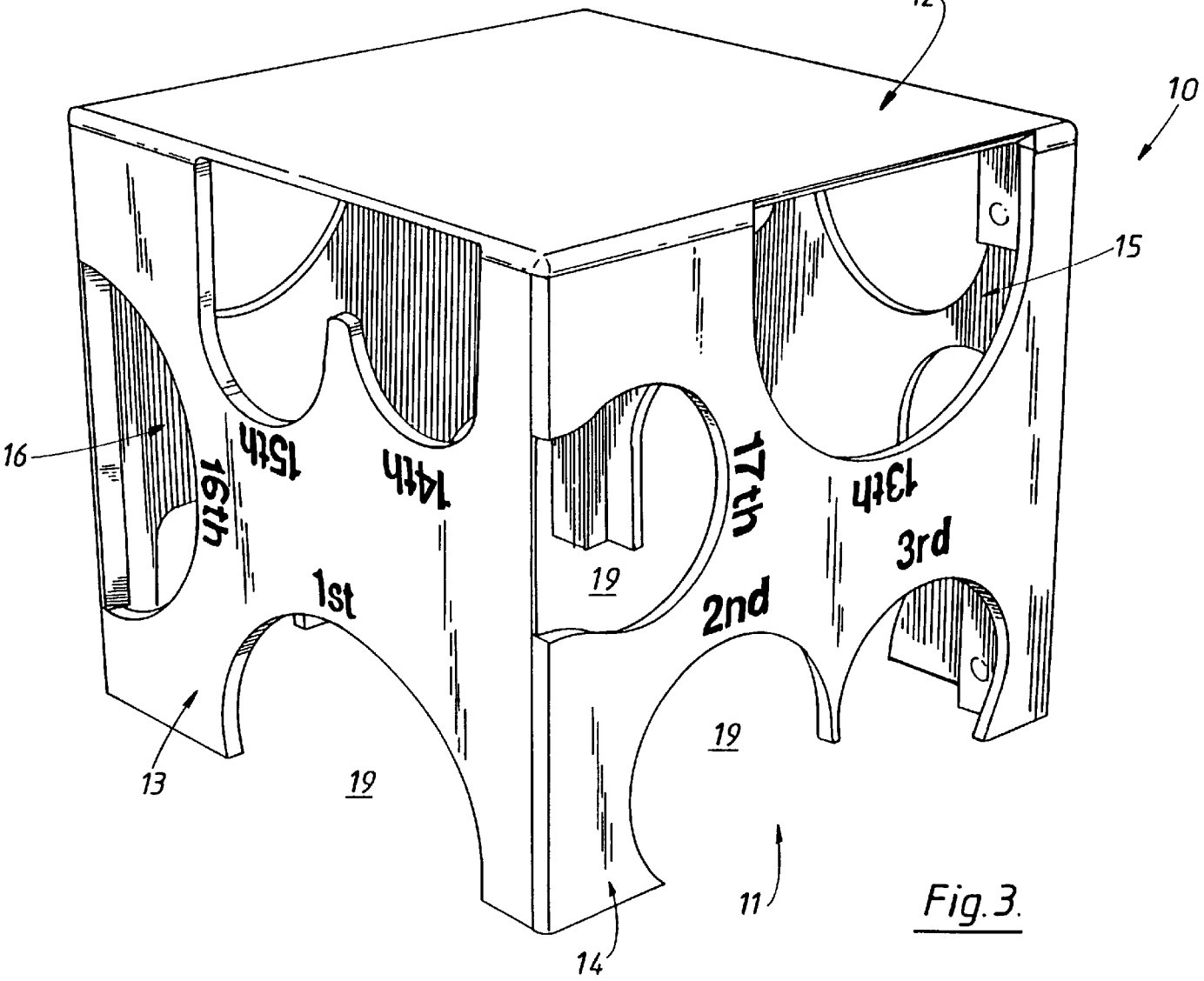
FIGS. 3 to 6 are respective perspective views of the putting aid.
Figure 4:
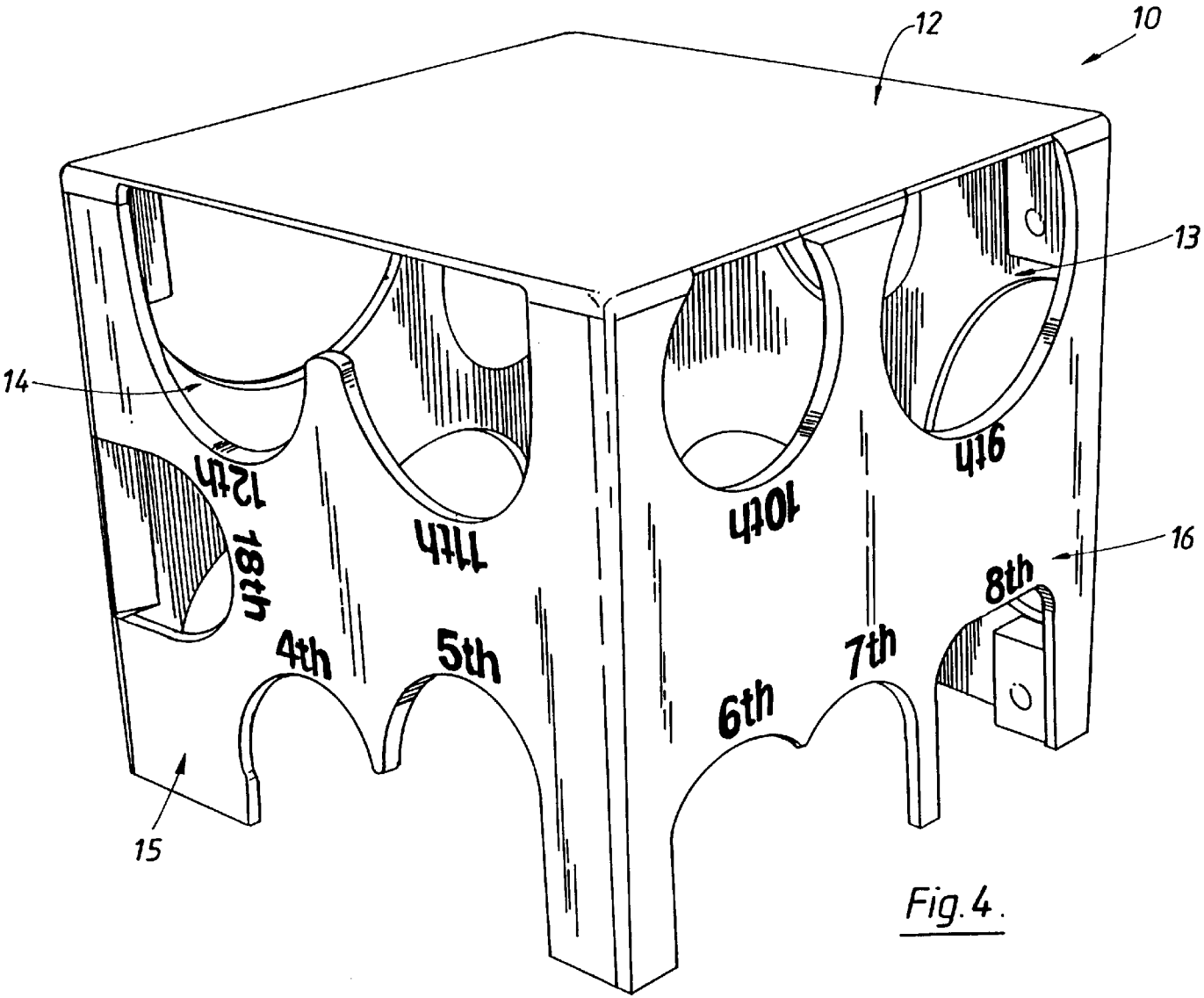
Figure 5:
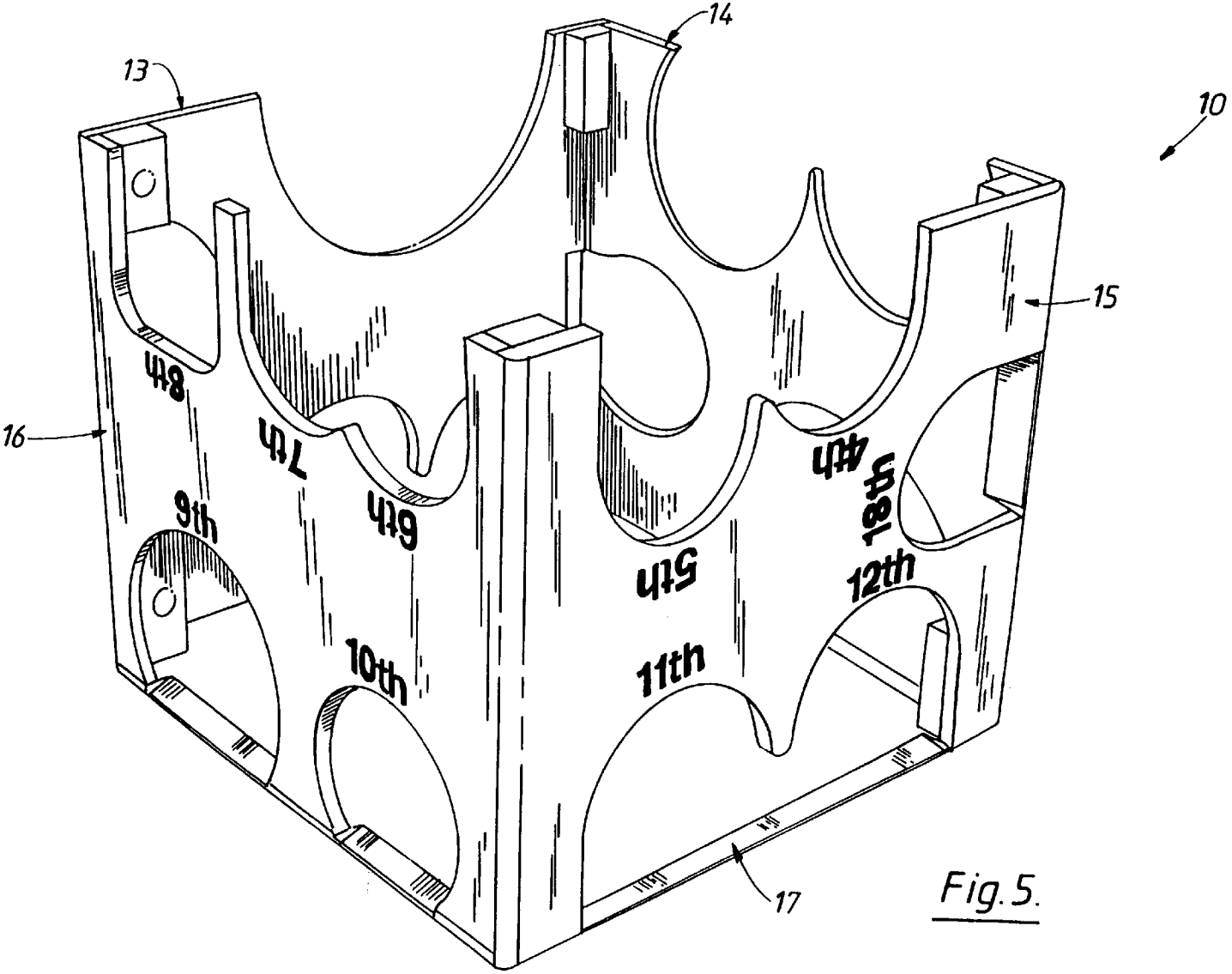
Figure 6:
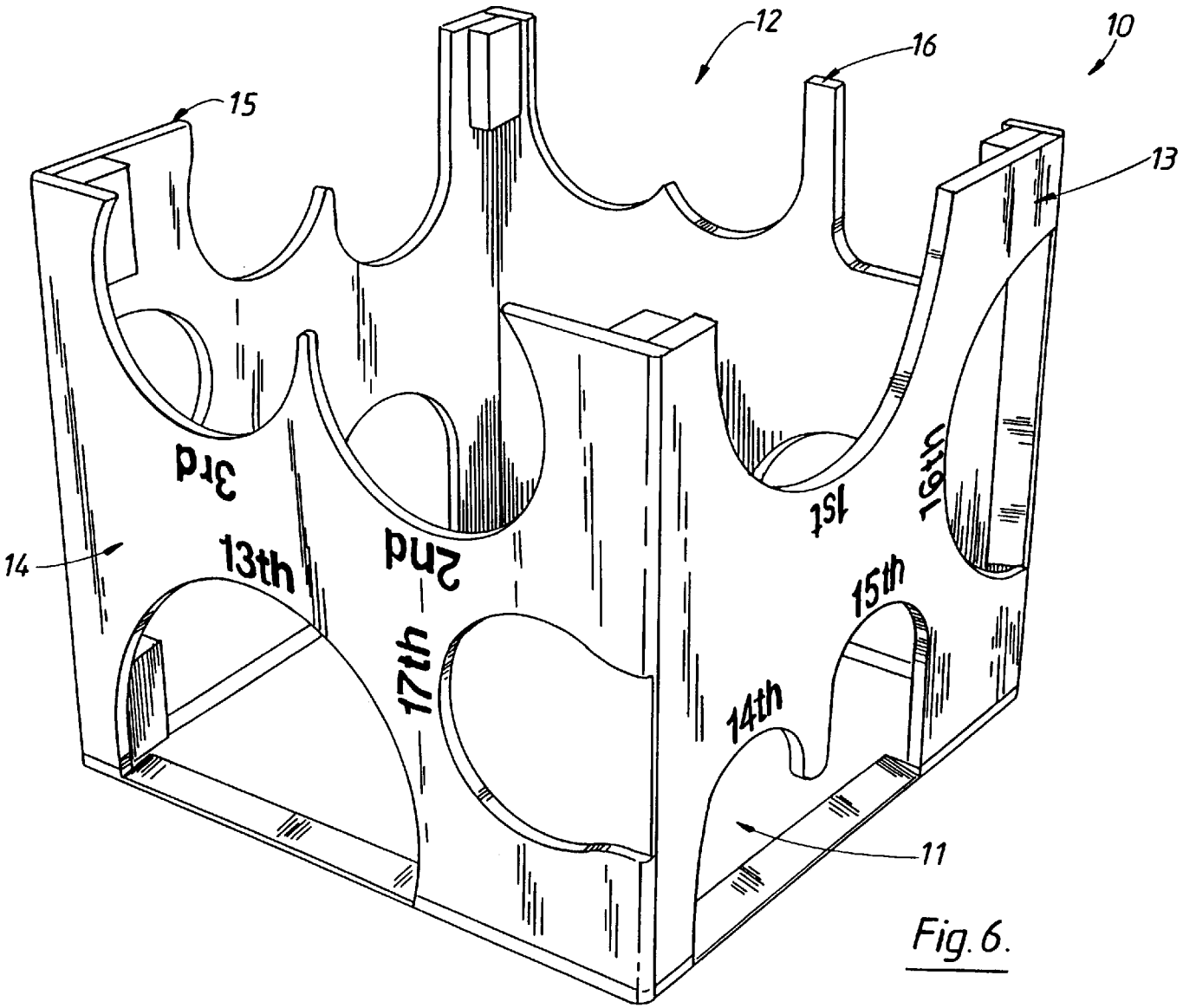

As shown in FIGS. 3 to 6, eighteen target holes 19 of different widths, heights and curvatures are provided in the remaining four faces 13–16 of the body of the aid 10, and these may be indicated as representing the "1st" to "18th" holes on a golf course. For example, the face 13, illustrated in FIG. 3, represents the "1st", "14th", "15th" and "16th" holes; while the face 15 illustrated in FIG. 4, represents the "4th", "5th", "11th", "12th" and "18th" holes. The face 12 has ramps 17 at the bases of the target holes 19 open to that face 12 to assist the balls entering the target holes 19.

As illustrated in the Index Sheets of FIGS. 8 and 9, each target hole 19 may be allocated a par value, preferably from 3–5, to correspond to the usual par values of the holes on real golf courses. Each target hole 19 may be allocated a difficulty index where the most difficult target hole 19 may have an index rating of 1 (ie, the 14th hole) and the easiest target hole 19 has an index rating of 18 (ie, the 13th hole). Different points may also be allocated to the different target holes 19.

Figure 7:
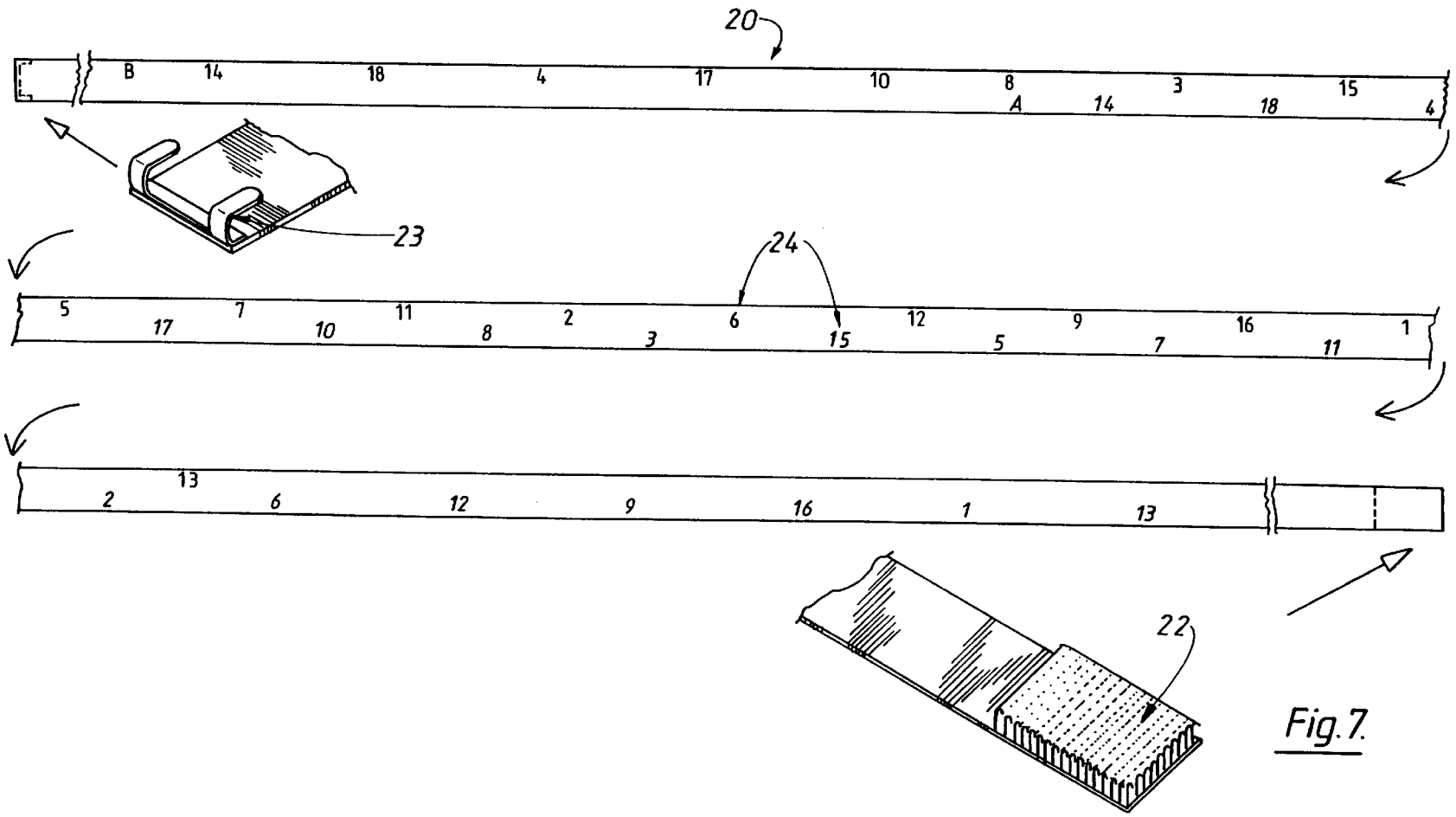
FIG. 7 is a perspective view of the index strip.

An indexing strip 20 (see FIG. 7) is preferably laid on the putting surface 21, eg, carpet, at substantially right angles to the particular face 13–16 of the aid 10 at which the golfer is attempting to putt to a specific target hole. The indexing strip 20 comprises a length of material provided with the hook portion of "Velcro" strip 22, or hook 23 at each end, which enables it to be releasably placed on the carpet 21. Numbers, representing the eighteen different target holes 19, may be provided, preferably at equal spacings, but preferably in random order, on the indexing strip. These indicate the position from which the golfer will attempt to putt for a particular target hole on the aid.

It will be noted that two sets of numbers 24, identified by respective letters "A" and "B", may be provided on the indexing strip 20 to provide different degrees of difficulty.

The player 30 plays the balls 40 with a conventional putter 50.

The Rules set out examples of alternative games which may be played using the putting aid or games between two or more players.

RULES

"Putting challenge has been designed to play eighteen holes of golf using the score card and index strip provided.

To play, lay index strip 20 at right angles to the putting aid 10 with No 1 index at furthest end from the aid 10. Align your left foot 31 with number from which you are to putt, ie, if putting to hole "1", align left foot with No 1 on index strip 20. The ball 40 remains in your stance as you would normally putt it.

To score, use hole "13" as an example. Hole "13" is a par 3 and the rating is index 18, which means it is the easiest hole to putt. A par is how many strokes it takes to get in the hole. For hole "13" (a par 3), you have three chances to putt it in the hole. If you putt it first time—a hole in 1 or eagle!. If you make it in two putts—a birdie!. An eagle is two less strokes to par; and a birdie is one less stroke to par. Putting challenge enables you to play all the games you would play on the golf course—stroke, stableford, match play, four ball best ball and ambrose.

Putting challenge played with three balls 40 can be used the same as for a dart-board. You can play 'around the course', where the first to finish from hole 1 through to hole 18 wins. '101 or 501' is where you choose the highest scoring holes for points and the first to 101 or 501 wins the game. If your first putt goes in, triple your score. If it takes two putts to score, double your points, but if three putts or more are taken, then you get the points on the score card.

'In-Offs'. To speed the game up, if a ball 40 stops near the hole 19, the next ball could be used to putt the first ball in, but every shot counts so you decide whether to plan in-off or not."

Alternatively, the golfer may simply use the aid as a means for improving his putting.

NB: As the target holes 19 in the aid 10 are smaller than the actual holes on golf courses, the golfer will become used to putting at a smaller target and so the allowable deviation error using the aid 10 is less than will allow the ball to be putted into holes on the golf course.

It will be readily apparent to the skilled addressee that although, eg, the "16th" hole is wider (at its base) than eg, the "13th" hole, the greater height of the "13th" hole may provide a wider target as the shallow height of the "16th"hole will only allow a golf ball to enter the "16th" hole within a narrow target band.

By variation of the width and/or the height and/or the shape of the target holes 19, the target holes 19 may be given different degrees of difficulty and these combinations can be multiplied by the different positions for the hole numbers 24 indicated by the indexing strips 20.

It will be readily apparent to the skilled addressee that there are many modifications and variations which may be made to the embodiments described without departing from the scope of the present invention defined in the appended claims.

I claim:

1. A golf putting aid for use on a playing surface comprising a plurality of polygon-shaped faces forming a hollow polyhedron wherein at least two of said polygon-shaped faces each comprise a plurality of openings therethrough for receipt therethrough of a putted golf ball and wherein each of said at least two polygon-shaped faces may be placed flat against the playing surface such that an opening in an adjacent one of said polygon-shaped faces is exposed for receipt therethrough of a putted golf ball.

2. A golf putting aid as in claim 1, wherein said hollow polyhedron is a six-sided polyhedron and is formed by at least five polygon-shaped faces.

3. A golf putting aid as in claim 2, wherein each said polygon-shaped face comprises a plurality of openings therethrough for receipt of a putted golf ball therethrough.

4. A golf putting aid as in claim 1, wherein at least two of said openings through said polygon-shaped faces are of differing sizes.

5. A golf putting aid as in claim 1, wherein at least two of said openings through said polygon-shaped faces are of differing shapes.

6. A golf putting aid as in claim 1, wherein a total of at least eighteen openings are provided through said polygon-shaped faces.

7. A golf putting aid as in claim 1, wherein a plurality of said polygon-shaped faces are connected such that said polyhedron is collapsible.

8. A golf putting aid as claimed in claim 1 combination with:

an indexing means for indicating one or more locations from which golf balls are to be putted towards the golf putting aid; and a set of Rules.

9. A golf putting aid as claimed in claim 8 wherein:

the indexing means comprises an elongate strip of material which is releasably engageable with said playing surface.

10. A golf putting aid as claimed in claim 9 wherein:

numbers representing different openings are marked on an upper face of the strip to indicate the different positions from which a golfer putts the balls towards the respective openings.

11. A golf putting aid as claimed in claim 8 wherein:

said Rules indicate at least one of a par value for each said opening, an index of difficulty for each said opening, and points allocated to each said opening.

* * * * *